US006019106A

United States Patent [19]

Okusawa et al.

[11] Patent Number: 6,019,106

[45] Date of Patent: Feb. 1, 2000

[54] EMBOSSED CIGARETTE WRAPPER WITH IMPROVED HOLDING FORCE

[75] Inventors: Toshiaki Okusawa; Shichisei Tani; Takashi Koyama; Takashi Yokoyama, all of Tokyo, Japan

[73] Assignee: Japan Tobacco Inc., Tokyo, Japan

[21] Appl. No.: 09/068,896

[22] PCT Filed: Sep. 24, 1997

[86] PCT No.: PCT/JP97/03383

§ 371 Date: May 22, 1998

§ 102(e) Date: May 22, 1998

[87] PCT Pub. No.: WO98/12939

PCT Pub. Date: Apr. 2, 1998

[30] Foreign Application Priority Data

Sep. 25, 1996 [JP] Japan ..... 8-253353

[51] Int. Cl.[7] ..... A24D 1/02; A24D 1/00; D21F 11/00

[52] U.S. Cl. ..... 131/365; 162/139; 131/364

[58] Field of Search ..... 131/365, 364; 162/139

[56] References Cited

U.S. PATENT DOCUMENTS

| | | | |
|---|---|---|---|
| 2,667,170 | 1/1954 | Lebert | 131/331 |
| 2,981,261 | 4/1961 | Rupert | 131/336 |
| 3,228,402 | 1/1966 | Lebert | 131/339 |

FOREIGN PATENT DOCUMENTS

| | | |
|---|---|---|
| 46-27358 | 8/1971 | Japan . |
| 58-122994 | 8/1983 | Japan . |
| 5-35900 | 5/1993 | Japan . |
| 5-73000 | 10/1993 | Japan . |
| 5-96100 | 12/1993 | Japan . |
| 7-5397 | 1/1995 | Japan . |

*Primary Examiner*—James Derrington
*Assistant Examiner*—Dionne A. Walls
*Attorney, Agent, or Firm*—Birch, Stewart, Kolasch & Birch, LLP

[57] ABSTRACT

A cigarette has a shredded tobacco filler and a paper for wrapping the filler. Many frusto-pyramidal portions biting into the filler are formed so as to be distributed on an inner surface of the paper except on both of the side edge portions of the inner surface. The inner surface, so formed, provides a high coefficient of friction with respect to the shredded tobacco filler. This cigarette contributes to preventing the dropping of shredded tobacco from the cut end of the cigarette.

16 Claims, 5 Drawing Sheets

EMBOSSED CIGARETTE WRAPPER WITH IMPROVED HOLDING FORCE

This application is the national phase under 35 U.S.C. §371 of prior PCT International Application No. PCT/JP97/03383 which has an International filing date of Sep. 24, 1997 which designated the United States of America, the entire contents of which are hereby incorporated by reference.

TECHNICAL FIELD

The present invention relates to a cigarette whose quality can be improved and maintained at the time of manufacture and in the subsequent distribution process.

BACKGROUND ART

One of the most important factors in improving the quality of cigarette is to prevent shredded tobacco from dropping from the cut end of cigarette. Therefore, the filling density at the cut end portion of cigarette is increased as compared with that at other portions, whereby the shredded tobacco is prevented from dropping from the cut end. More specifically, although a cigarette is produced by cutting a tobacco rod as publicly known, the tobacco rod has, at fixed intervals, high-density portions in which the filling density of shredded tobacco is increased. The tobacco rod is cut at the high-density portions to obtain cigarettes or double cigarettes. The double cigarette having a length twice as long as that of cigarette which has a high-density portion remained at the center thereof.

However, even if the tobacco rod is cut at the high-density portions, shredded tobacco sometimes drops from the cut end of cigarette or double cigarette. Also, when the double cigarette is cut into two cigarettes to produce a filter cigarette from the double cigarette, shredded tobacco sometimes drops from the cut end of cigarette in the subsequent transportation process thereof.

Further, not only at the time of manufacture of cigarettes or filter cigarettes as described above, but also in the subsequent distribution process, shredded tobacco sometimes drops from the cut end of cigarette or filter cigarette.

Nowadays, a cigarette manufacturing machine for manufacturing a tobacco rod has a tendency toward higher speed, so that a slip between the paper and the stream of shredded tobacco increases. Such an increase in slip causes variations in formation and pitch of high-density portions in tobacco rod, and also causes the shredded tobacco to be broken. As a result, the filling density and holding force of shredded tobacco at the cut end of cigarette or double cigarette are decreased.

DISCLOSURE OF THE INVENTION

An object of the present invention is to provide a cigarette which can prevent shredded tobacco from dropping from the cut end thereof and is suitable for a higher-speed cigarette manufacturing machine.

To achieve the above object, a cigarette in accordance with the present invention comprises a shredded tobacco filler; a paper for wrapping the filler, the paper having lap portion formed by both of side edge portions to be lapped and bonded to each other; and means for increasing a coefficient of friction of the paper with respect to the filler.

According to the above-described cigarette, the inner surface of paper has a high coefficient of friction with respect to the shredded tobacco filler. Therefore, the paper firmly holds the shredded tobacco filler, so that the dropping of shredded tobacco from the cut end of cigarette is decreased. In the process of manufacture of cigarettes, before the shredded tobacco filler is wrapped with the paper, the slip between the paper and the filler is decreased. This decrease in slip inhibits variations in filling density in the tobacco rod, permits exact cutting of tobacco rod, and reduces the breakage of shredded tobacco. This greatly contributes to the prevention of dropping of shredded tobacco from the cut end of cigarette.

Specifically, the means for increasing the coefficient of friction includes frusto-pyramidal formulations or convex portions formed so as to be distributed on the inner surface of paper. These convex portions bite into the shredded tobacco filler, so that the paper firmly holds the filler. The convex portions are formed at least at the paper portion corresponding to the cut end portion of cigarette. Even in this case, the shredded tobacco is effectively prevented from dropping from the cut end of cigarette. The convex portions may be distributed in the whole area of the paper, or in the whole area of the paper except both the side edge portions of the paper. In the case where the convex portions are not formed at both the side edge portions of the paper, the side edge portions are bonded well.

The convex portions are easily obtained by embossing the paper. It is preferable that the embossing in this case increase the permeability of paper. If the permeability of paper is increased, the amount of carbon monoxide in the tobacco smoke inhaled by a smoker is decreased, whereby the ratio of carbon monoxide to tar is reduced.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
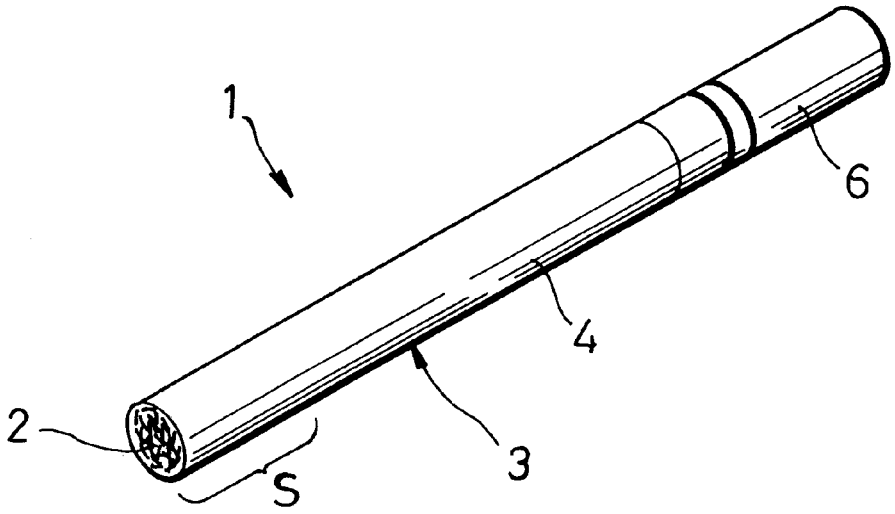
FIG. 1 is a perspective view showing one embodiment of a filter cigarette.
Figure 2:
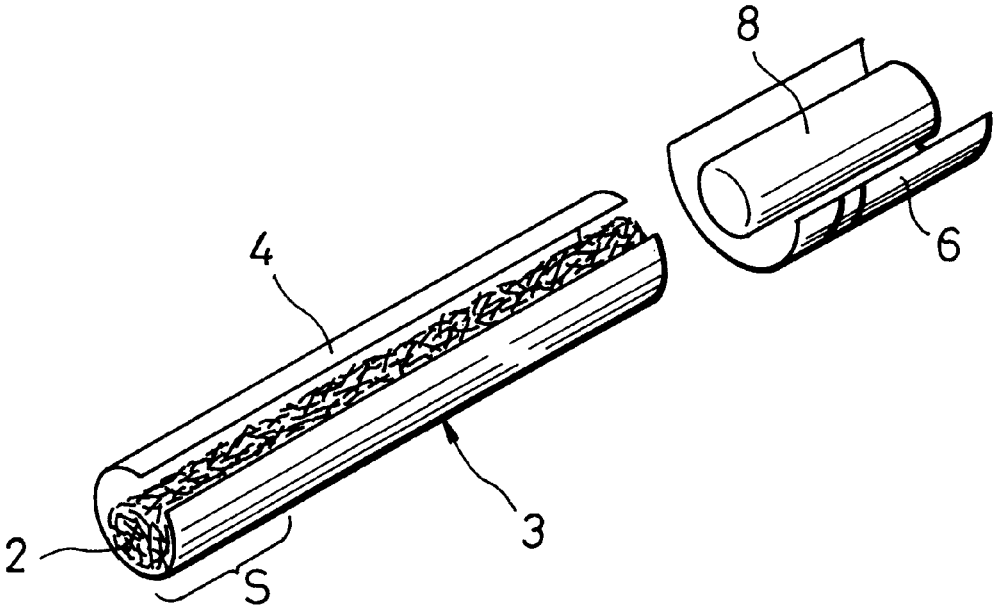
FIG. 2 is an exploded perspective view of the filter cigarette shown in FIG. 1.

Referring to FIGS. 1 and 2, a filter cigarette 1 comprises a cigarette 3 and a filter 8. The cigarette 3 is formed by wrapping a shredded tobacco filler, that is, a filler 2 with a paper 4. The filter 8 is connected to one end of the cigarette 3 by means of a tip paper 6. The tip end portion, that is, the S zone of the cigarette 3 has a higher filling density of the filler 2 than other portions.

Figure 3:
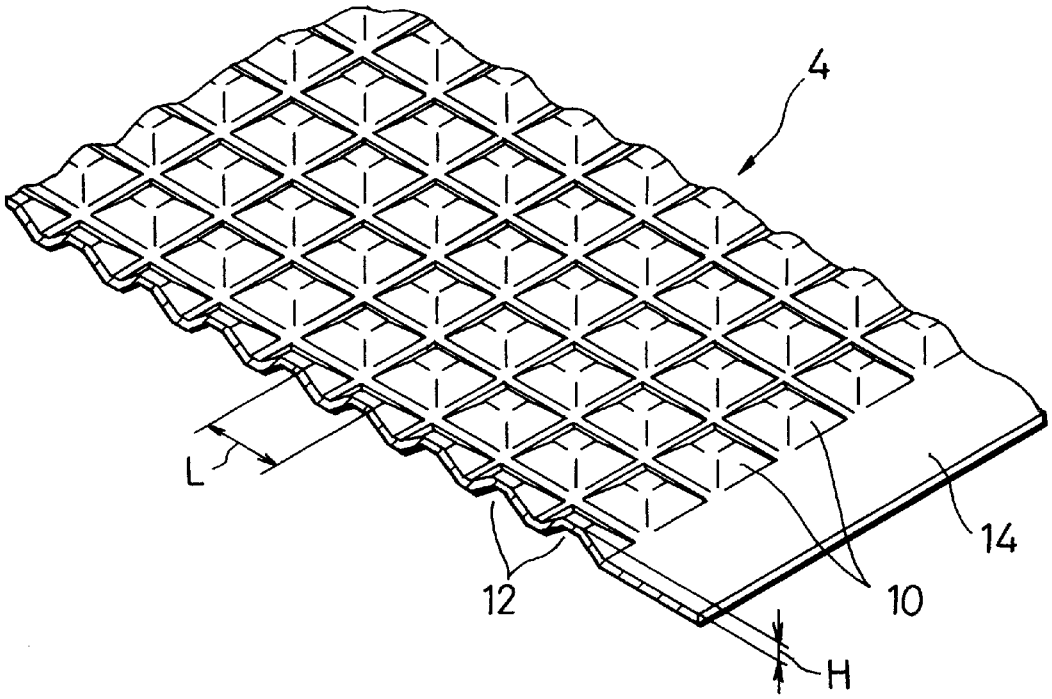
FIG. 3 is a perspective view showing a part of paper in an enlarged manner.

FIG. 3 shows a part of the paper 4 in an enlarged manner. The paper 4 shown in FIG. 3 is expanded with the back surface up, and one side edge portion 14 is also shown in the figure. That is, the paper 4 expands in the direction of diagonal line toward the upper right in the figure.

As is apparent from FIG. 3, the back surface of the paper 4 has many convex portions 10, while the outside surface thereof has concave portions 12 corresponding to the convex portions 10, except for both of the side edge portions 14 of the paper 4. The convex portions 10 are arranged in a matrix form, for example, having an arrangement of 40×40 per 25.4 $mm^2$. In FIG. 3, the pitch and height of the convex portion 10 are denoted by L (=0.64 mm) and H (=0.16 mm), respectively. Each convex portion 10 has a shape of a truncated pyramid. However, the convex portion 10 may have a shape of circular cone or triangular pyramid, or the arrangement of convex portions may be formed with differently shaped convex portions. Further, the pitch of the convex portions 10 may be changed arbitrarily.

Both of the side edge portions 14 of the paper 4 are lapped and bonded to each other when the cigarette 3 is formed. Therefore, the side edge portions 14 having no convex portions 10, are flat. However, the convex portions may be distributed over the whole back surface of the paper 4 including the side edge portions 14, or may be distributed in the S zone only of the cigarette 3 (regardless of whether the convex portions 10 are distributed at the side edge portions or not).

Figure 4:
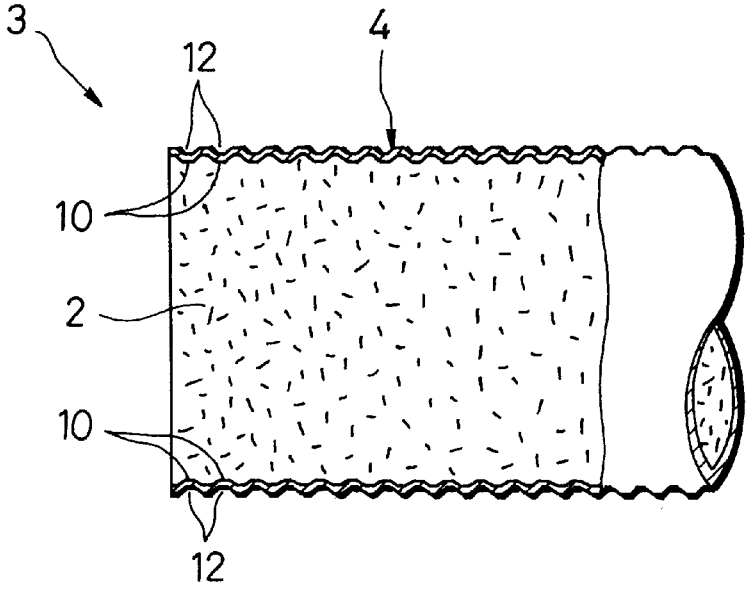
FIG. 4 is a longitudinal sectional view of the tip end of the filter cigarette.

FIG. 4 is an enlarged sectional view of the tip end of the filter cigarette 1. As is apparent from FIG. 4, the convex portions 10 of the paper 4 bite into the filler 2, so that a high frictional resistance arises between the paper 4 and the filler 2. This frictional resistance arises in all directions along the back surface of the paper 4.

According to the aforementioned cigarette 3, the filler 2 is wrapped firmly and held by the paper 4 because of the presence of frictional resistance between the paper 4 and the filler 2. As a result, the filler 2, that is, the shredded tobacco does not move in the cigarette 3, so that the shredded tobacco is prevented from dropping from the cut end of the cigarette 3.

Figure 5:
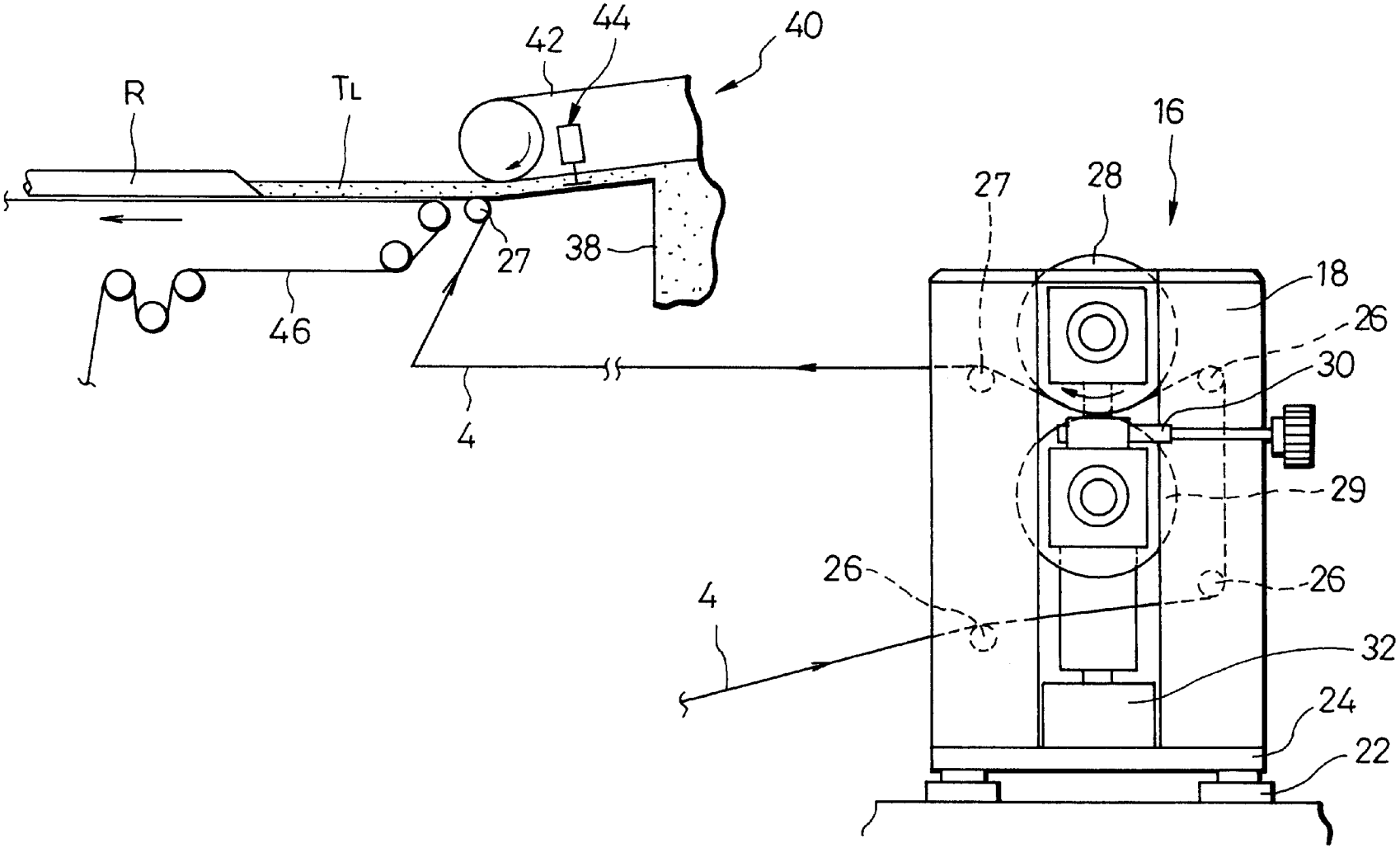
FIG. 5 is a schematic view showing a part of a cigarette manufacturing machine equipped with an embossing apparatus.

FIG. 5 schematically shows a part of a cigarette manufacturing machine for manufacturing the aforesaid cigarette 3. This cigarette manufacturing machine is equipped with an embossing apparatus 16, and this embossing apparatus 16 is disposed in the feed path of the paper 4. The embossing apparatus 16 has a frame 18, and a base 24 for this frame 18 is installed on the floor via a plurality of legs 22. In the frame 18, a pair of rollers 28 and 29 are arranged vertically to emboss the paper 4. These rollers 28 and 29 can be rotated in the direction reverse to each other. The paper 4 is reeled out from a roll (not shown), and introduced to between the rollers 28 and 29 via a plurality of guide rollers 26. The paper 4 having passed between the rollers 28 and 29 is fed to a rod forming section of the cigarette manufacturing machine via a plurality of guide rollers 27.

The apparatus 16 is provided with a unit 30 for regulating a clearance between the rollers 28 and 29. Specifically, the regulating unit 30 regulates the distance between the axes of the upper and lower rollers 28 and 29. An air cylinder 32, which is installed on the base 24, pushes the lower roller 29 toward the upper roller 28.

When the paper 4 passes between the rollers 28 and 29, a matrix arrangement of the convex portions 10 is formed in the whole area of the paper 4 except both of the side edge portions 14, and thereafter the paper 4 is fed to the rod forming section.

The following is a detailed description of the rollers 28 and 29.

Figure 6:
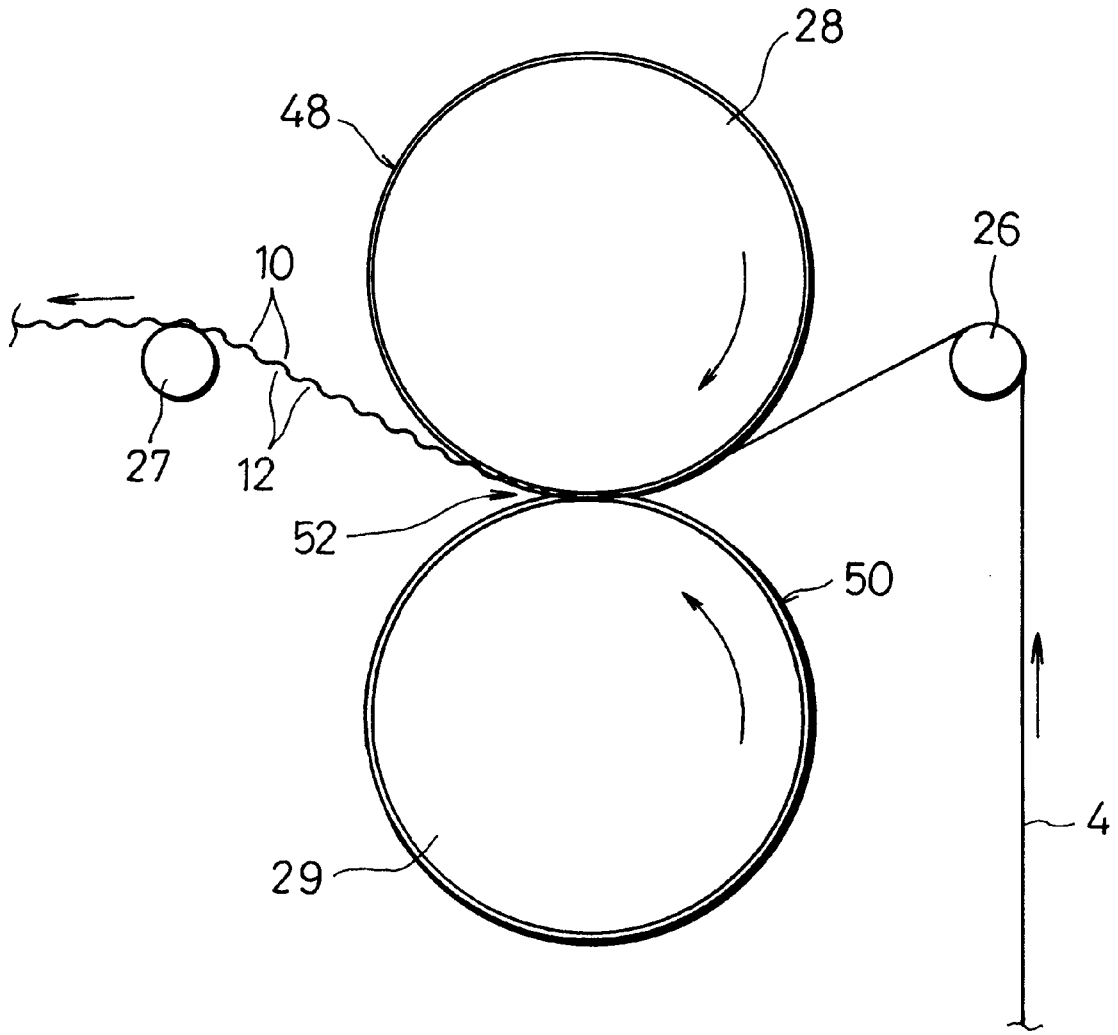
FIG. 6 is a schematic view showing the embossing of paper.

As shown in FIG. 6, the lower roller 29 has an outer peripheral surface 50 provided with protrusions of matrix arrangement corresponding to the convex portions 10 of the paper 4, whereas the upper roller 28 has an outer peripheral surface 48 provided with holes corresponding to the protrusions of the roller 29. Therefore, the rolls 28 and 29 rotate while these outer peripheral surfaces 48 and 50 engage with each other.

When the paper 4 passes between the upper and lower rollers 28 and 29, the outer peripheral surface 50, that is, the protrusion of the roller 29 engages with the outer peripheral surface 48, that is, the hole of the roller 28 via the paper 4. Therefore, a matrix arrangement of the convex portions 10 is formed on the back surface of the paper 4, and this matrix arrangement of the convex portions 10 forms a matrix arrangement of the concave portions 12 on the outside surface of the paper 4. In other words, the paper 4 except both of the side edge portions is subjected to embossing. The convex portions 10 formed by embossing, thus, increase the permeability of the paper 4.

Subsequently, the paper 4 is fed to the rod forming section of the cigarette manufacturing machine as shown in FIG. 5. At the rod forming section, the stream of shredded tobacco is wrapped with the paper 4, by which a tobacco rod R is formed continuously.

The cigarette manufacturing machine will be described briefly.

The cigarette manufacturing machine is provided with a conveyor unit 40, which has a suction belt, that is, a conveyor belt 42. The conveyor belt 42 sucks shredded tobacco in a layer form from a chimney 38, so that a shredded tobacco layer $T_L$ is formed on the lower surface of the conveyor belt 42. This shredded tobacco layer $T_L$ is conveyed to the rod forming section as the conveyor belt 42 runs. In this conveying process, the thickness of the shredded tobacco layer $T_L$ is controlled by a trimming apparatus 44, so that portions having an increased thickness are formed periodically in the shredded tobacco layer $T_L$.

Subsequently, the shredded tobacco layer $T_L$ is supplied from the conveyor belt 42 onto the paper 4. The paper 4 is lapped over a garniture belt 46, so that the paper 4 passes through the rod forming section together with the shredded tobacco layer $T_L$ as the garniture belt 46 runs. The garniture belt 46, which is set around via a plurality of rollers, runs in the direction of the arrow in FIG. 5 as the driving drum (not shown) is rotated.

At the rod forming section, the shredded tobacco layer $T_L$ is wrapped with the paper 4 as publicly known, by which the tobacco rod R is formed continuously. At the rod forming section, glue is applied to one side edge of the paper 4, and both of the side edges of the paper 4 are bonded to each other by being lapped.

In the above-described cigarette manufacturing machine, the paper 4 and the shredded tobacco layer $T_L$ are carried at a high speed together with the garniture belt 46. At this time, the shredded tobacco layer $T_L$ and the paper 4 are carried together by the frictional resistance between them. Since the paper 4 has been embossed, the frictional resistance between the paper 4 and the shredded tobacco layer $T_L$ is high, so that a slip of the shredded tobacco layer $T_L$ with respect to the paper 4 is decreased.

Subsequently, at the cutting section of the cigarette manufacturing machine, the tobacco rod R is cut exactly at the aforesaid portions where the thickness of the shredded tobacco layer $T_L$ is increased, by which a cigarette or double cigarette is formed. The double cigarette is supplied to a filter attachment, where filter cigarettes 1 are formed.

If the cigarette manufacturing machine is provided with the aforementioned embossing apparatus 16, a special paper need not be used, and the tobacco rod R can be formed while the ordinary paper is embossed. Therefore, even if the operation speed of the cigarette manufacturing machine is increased, the slip of the shredded tobacco layer $T_L$ with respect to the paper 4 is decreased, so that the tobacco rod R is cut exactly.

The aforementioned embossing apparatus 16 embosses the paper 4 except both of the side edge portions 14 thereof. The rollers 28 and 29 of the embossing apparatus 16 may emboss the whole surface of the paper 4, or embosses the paper 4 periodically. In the latter case, protrusion or hole distributing regions are provided at intervals in the circumferential direction of roller on the outer surfaces of the rollers 28 and 29.

If the paper 4 has been embossed in advance, the cigarette manufacturing machine need not be equipped with the embossing apparatus 16.

Figure 7:
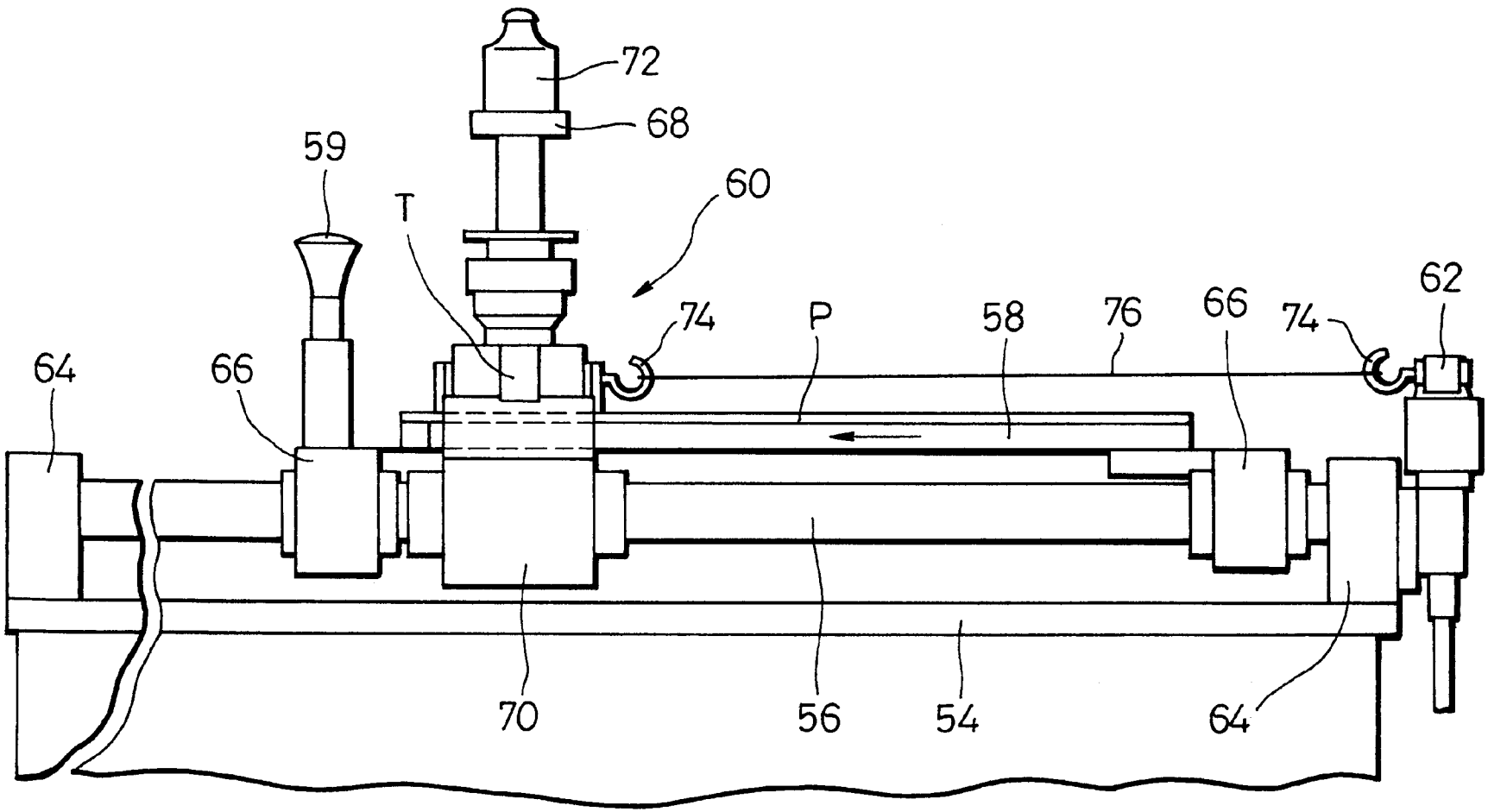
FIG. 7 is a front view of a measuring apparatus for coefficient of friction.

FIG. 7 shows an apparatus for measuring the coefficient of friction of the paper 4. This measuring apparatus mainly includes a base 54, a guide rod 56, a sample table 58, a support 60, and a load sensor 62. The guide rod 56 extends horizontally just above the base 54, and both ends of the guide rod 56 are supported by the base 54 via legs 64. The sample table 58 extends horizontally just above the guide rod 56, and has a slider 66 at each end thereof. The slider 66 is attached to the guide rod 56. Therefore, the sample table 58 is supported in such a manner as to be movable along the guide rod 56. A part of the paper 4 having been embossed can be set on the sample table 58 as a sample P.

The support 60 has a shape such as to stride over the sample table 58. The lower end of the support 60 is attached to the guide rod 56 via a slider 70. The support 60 is provided with a load applying rod 68, which is movable vertically. The load applying rod 68 has a receiving face for a weight 72 at the upper end thereof. A space capable of containing shredded tobacco T is formed in the support 60, and the shredded tobacco T in this space is held between the lower end of the load applying rod 68 and the sample P on the sample table 58. Therefore, the shredded tobacco T in the space is subjected to a load corresponding to the load applying rod 68 and the weight 72.

One leg 64 of the guide rod 56 is fitted with the load sensor 62. The load sensor 62 and the support 60 are connected to each other via a pair of hooks 74 and a wire 76. The load sensor 62 is fixed to the leg 64 of the guide rod 56, and the movement of the support 60 in the direction along the guide rod 56 is restricted.

When being subjected to a tensile force via the wire 76, the load sensor 62 can display the value of the tensile force in units of weight at the display portion (not shown).

The following is a description of a procedure for measuring the coefficient of friction of the sample P.

First, the sample P is set on the sample table 58. The sample P has a length of 100 mm. Then, 1 g of shredded tobacco T is set in the space in the support 60, that is, on the sample P. Thereby, the measurement of the coefficient of friction of the sample P is made possible.

If the sample table 58 is pulled in the direction indicated by the arrow in FIG. 7 via a handle 59, the support 60 is subjected to a drag force caused by the frictional resistance between the sample P and the shredded tobacco T. This drag force is transmitted to the load sensor 62 via the wire 76. The load sensor 62 detects and displays the drag force, that is, the frictional resistance between the sample P and the shredded tobacco T.

If the pulling force of the sample table 58 increases further, the frictional resistance also increases. Thereafter, the sample table overcomes the frictional resistance and begins to move in the direction indicated by the arrow in FIG. 7. At this time, the detection value of the load sensor 62 is read, and this detection value indicates a static frictional resistance between the sample P and the shredded tobacco T, that is, a static frictional force. When the sample table 58 is moved stably, the detection value of the load sensor 62 indicates a kinetic frictional force. By dividing the static frictional force and kinetic frictional force thus obtained by the load given to the shredded tobacco T, a coefficient of static friction and coefficient of dynamic friction are calculated, respectively.

The above-mentioned measurements were made five times each on four kinds of samples P. The measurement results are given in Table 1. The measurement results given in Table 1 are average values. The samples P1 to P3 each are a part of embossed paper, but has a different shape of the convex portion 10. The sample P4 is a part of flat paper.

TABLE 1

| | Static friction | | Kinetic friction | |
|---|---|---|---|---|
| | Frictional force (gf) | Coefficient of friction | Frictional force (gf) | Coefficient of friction |
| Sample P1 | 535.8 | 1.072 | 486.9 | 0.974 |
| Sample P2 | 528.1 | 1.056 | 429.1 | 0.858 |
| Sample P3 | 563.9 | 1.128 | 500.4 | 1.001 |
| Sample P4 | 443.0 | 0.886 | 403.0 | 0.806 |

As is apparent from the measurement results in Table 1, the samples P1 to P3 have a high frictional force and coefficient of friction than the sample P4.

Next, comparison was made between the manufacture of filter cigarette using an ordinary paper P4 and the manufacture of filter cigarette using embossed papers P5 and P6 regarding the quantity of shredded tobacco dropping from the cigarette. In this case, the concave portions of the papers P5 and P6 had depths of 55 $\mu$m and 65 $\mu$m, respectively.

The dropping quantity of shredded tobacco is a difference between the reference filling quantity of shredded tobacco corresponding one cigarette of tobacco rod R and the actual filling quantity of shredded tobacco in a filter cigarette. By dividing the dropping quantity of shredded tobacco by the reference filling quantity, a dropping ratio can be obtained.

If the difference between the standard dropping quantity of shredded tobacco in the cigarette manufactured using the paper P4 and the dropping quantity of shredded tobacco in the cigarette manufactured using the embossed papers P5 and P6 is divided by the standard dropping quantity, the divided value indicates a dropping quantity reduction ratio in the case where an embossed paper is used.

The dropping ratio and dropping quantity reduction ratio of shredded tobacco for the papers P4 to P6 are given in Table 2.

TABLE 2

| | Dropping ratio (%) | Dropping quantity reduction ratio (%) |
|---|---|---|
| Paper P4 | 1.91 | — |
| Paper P5 | 1.32 | 30.9 |
| Paper P6 | 1.47 | 23.0 |

As is apparent form Table 2, the filter cigarettes using the papers P5 and P6 have a lower dropping ratio than the filter cigarette using the paper P4, and the embossing of paper greatly improves the dropping ratio of shredded tobacco.

Next, a smoking test was made on the filter cigarette using the paper P4 and the filter cigarette using an embossed paper P7. In this smoking test, the ratio of the weight of carbon monoxide to the weight of tar in tobacco smoke inhaled by a smoker, that is, the CO/T ratio per one filter cigarette was measured. The measurement results are given in Table 3. For the paper P7, the concave portion 12 has a depth of 85 $\mu$m.

TABLE 3

| | CO/T |
|---|---|
| Paper P4 | 1.04 |
| Paper P7 | 0.94 |

As is apparent from Table 3, the filter cigarette using the embossed paper P7 has a lower CO/T ratio than the filter cigarette using the paper P4. This is probably because the permeability of the paper 4 is increased by embossing, whereby the oxidation of CO is accelerated.

According to the cigarette or filter cigarette in accordance with the present invention, both of the coefficient of static friction and the coefficient of dynamic friction between the paper and the shredded tobacco filler increase. Therefore, the embossed paper firmly holds the shredded tobacco filler, so that the shredded tobacco is prevented from dropping from the cut end of cigarette or filter cigarette. The dropping of shredded tobacco is also reduced in the process of manufacture of cigarettes or filter cigarettes.

Even if the operation speed of a cigarette manufacturing machine is increased, the slip between the paper and the shredded tobacco layer is decreased. This decrease in slip permits exact cutting of tobacco rod at the portions where the thickness of shredded tobacco layer is increased, and reduces the breakage of shredded tobacco. This greatly contributes to the prevention of dropping of shredded tobacco from the cut end of cigarette or double cigarette.

Further, according to the cigarette or filter cigarette in accordance with the present invention, the CO/T ratio of tobacco smoke inhaled by a smoker is decreased.

The invention being thus described it will be obvious that the same may be varied in many ways. Such variations are not to be regarded as a departure from the spirit and scope of the invention, and all such modifications as would be obvious to one skilled in the art intended to be included within the scope of the following claims.

We claim:

1. A cigarette comprising:

a shredded tobacco filler;

a paper for wrapping said filler, said paper having a lap portion formed by both of the paper side edge portions to be lapped and bonded to each other; and a matrix of frusto-pyramidal formations on an interior surface area of said paper, the frusto-pyramidal formations increasing a coefficient of friction of said paper with respect to said filler.

2. The cigarette according to claim 1, wherein said frusto-pyramidal formations are formed at least at a paper portion corresponding to the cut end of cigarette.

3. The cigarette according to claim 1, wherein said frusto-pyramidal formations are formed on a surface area of said paper except on at least one side edge portion of said paper.

4. The cigarette according to claim 1, wherein said frusto-pyramidal formations are formed on an entire surface area of said paper.

5. The cigarette according to claim 1, wherein said frusto-pyramidal formations are obtained by embossing said paper.

6. The cigarette according to claim 5, wherein said frusto-pyramidal formations increase the permeability of said paper.

7. The cigarette as defined in claim 1, further comprising a filter.

8. The cigarette as defined in claim 1, wherein the frusto-pyramidal formations are formed as adjacent rows of frusto-pyramids.

9. The cigarette as defined in claim 8, wherein bases of at least two frusto-pyramidal formations are separated by a flat surface of said paper.

10. The cigarette as defined in claim 9, wherein said flat surface is formed along at least one tetragonal side of each frusto-pyramidal formation.

11. The cigarette as defined in claim 1, wherein an apex and at least one side of each of said frusto-pyramidal formations are formed along a line extending at an interior obtuse downward angle.

12. The cigarette as defined in claim 11, wherein each of said frusto-pyramidal formations has four sides extending downward to form a base.

13. The cigarette as defined in claim 12, wherein said apex of each of said frusto-pyramidal formations is flat, the flat surface of said apex is a plane in parallel with the surface of the paper.

14. The cigarette as defined in claim 13, wherein said apex has a surface area less than the surface area formed by said base of each of said frusto-pyramidal formations, said apex and said base formed in two parallel planes.

15. The cigarette as defined in claim 1, wherein the matrix of frusto-pyramidal formations is arranged at least 40×40 per 25.4 $mm^2$ of paper.

16. The cigarette as defined in claim 1, wherein at least one frusto-pyramidal formation is separated from an adjacent frusto-pyramidal formation by a distance of at least 0.64 mm, the distance measured from a near proximity flat surface of an apex of said at least one frusto-pyramidal formation to a far proximity flat surface side apex of said adjacent frusto-pyramidal formation.

* * * * *